US009700853B2

(12) United States Patent
Yokota et al.

(10) Patent No.: US 9,700,853 B2
(45) Date of Patent: Jul. 11, 2017

(54) GAS-LIQUID DISSOLVING TANK AND MICROSCOPIC BUBBLE GENERATOR

(71) Applicant: KABUSHIKI KAISHA YOKOTA SEISAKUSHO, Hiroshima-shi, Hiroshima (JP)

(72) Inventors: Hiroshi Yokota, Hiroshima (JP); Fumio Nishi, Hiroshima (JP); Isao Kawamoto, Hiroshima (JP)

(73) Assignee: KABUSHIKI KAISHA YOKOTA SEISAKUSHO, Hiroshima-shi (JP)

( * ) Notice: Subject to any disclaimer, the term of this patent is extended or adjusted under 35 U.S.C. 154(b) by 66 days.

(21) Appl. No.: 14/763,580

(22) PCT Filed: Jan. 28, 2014

(86) PCT No.: PCT/JP2014/052374

§ 371 (c)(1),
(2) Date: Jul. 27, 2015

(87) PCT Pub. No.: WO2014/119775

PCT Pub. Date: Aug. 7, 2014

(65) Prior Publication Data

US 2015/0352505 A1 Dec. 10, 2015

(30) Foreign Application Priority Data

Jan. 31, 2013 (JP) ..... 2013-017525

(51) Int. Cl.
*B01F 3/04* (2006.01)
*B01F 15/00* (2006.01)
(Continued)

(52) U.S. Cl.
CPC ..... *B01F 3/04985* (2013.01); *B01F 5/0068* (2013.01); *B01F 5/0604* (2013.01);
(Continued)

(58) Field of Classification Search
CPC ..... B01F 3/04; B01F 3/04985; B01F 5/0602; B01F 5/0604; B01F 5/0068
(Continued)

(56) References Cited

U.S. PATENT DOCUMENTS

2003/0011082 A1 1/2003 Tanabe et al.
2012/0126436 A1 5/2012 Hato

FOREIGN PATENT DOCUMENTS

JP 49-36575 A 4/1974
JP 51-46671 B2 12/1976
(Continued)

OTHER PUBLICATIONS

International Preliminary Report on Patentability for PCT/JP2014/052374, Chapter I, issued Aug. 4, 2015.

*Primary Examiner* — Robert A Hopkins
(74) *Attorney, Agent, or Firm* — Kratz, Quintos & Hanson, LLP

(57) ABSTRACT

This invention provides a microscopic bubble generator that can stably/efficiently generate a large amount of microscopic bubbles in liquid in a short time and can be easily cleaned in an assembled state and in a disassembled state, and a gas-liquid dissolving tank that can be suitably used for the apparatus.

In the gas-liquid dissolving tank that promotes dissolution of gas mixed with liquid in the liquid, openings that pass the flowing gas-liquid are formed at an upper portion and a lower portion of a container of the tank, a plurality of separation walls that vertically divide a plurality of chambers are disposed in the container, openings that connect upper and lower chambers are formed through the separation walls, the upper ends of the openings of the separation walls extend predetermined distances upward from the separation
(Continued)

walls, and the lower ends of the openings of the separation walls extend predetermined distances downward from the separation walls.

20 Claims, 13 Drawing Sheets

(51) Int. Cl.
*B01F 5/00* (2006.01)
*B01F 5/06* (2006.01)
*B01F 5/10* (2006.01)

(52) U.S. Cl.
CPC ..... *B01F 5/106* (2013.01); *B01F 15/00123* (2013.01); *B01F 15/00155* (2013.01); *B01F 2003/04858* (2013.01)

(58) Field of Classification Search
USPC ..... 261/119.1, 121.1
See application file for complete search history.

(56) References Cited

FOREIGN PATENT DOCUMENTS

| | | | | |
|---|---|---|---|---|
| JP | 7-328402 | A | 12/1995 | |
| JP | 10-230150 | A | 9/1998 | |
| JP | 2594104 | Y2 | 4/1999 | |
| JP | 11-207162 | A | 8/1999 | |
| JP | 2001-58142 | A | 3/2001 | |
| JP | 2002-85949 | A | 3/2002 | |
| JP | 2002-159989 | A | 6/2002 | |
| JP | 2002-336668 | A | 11/2002 | |
| JP | 2008-290011 | A | 12/2008 | |
| JP | 2011-88079 | A | 5/2011 | |
| KR | WO 2008147050 | A1 * | 12/2008 | ..... B01F 3/0446 |

* cited by examiner

PRIOR ART

PRIOR ART

GAS-LIQUID DISSOLVING TANK AND MICROSCOPIC BUBBLE GENERATOR

TECHNICAL FIELD

The present invention relates to an apparatus for generating microscopic bubbles in liquid and a gas-liquid dissolving tank that can be very suitably used for the apparatus.

BACKGROUND ART

It has been known that it is advantageous to keep oxygen dissolved by diffusing bubbles in water in order to activate bacteria for water treatment or grow/activate aquatic organisms in sewerage/aquaculture and the like. Further, even in the manufacturing industry, it has been widely known that it is advantageous to diffuse bubbles in liquid in order to promote a gas-liquid reaction.

To this end, it is preferable to reduce the size of bubbles as small as possible in order to keep bubbles in liquid longer by reducing buoyancy of the bubbles and increase reaction efficiency by increasing a surface area that comes in contact with liquid.

As a method of diffusing bubbles in water in the prior art, for example, a method of discharging compressed air from a compressor through fine holes such as diffuser tubes or a method of mixing and stirring bubbles in water by rotating a bladed wheel in the water is the most typical.

However, there was a problem in these methods in that the cost of the equipment is high and maintenance is difficult, and discharging bubbles through fine holes or mixing and stirring bubbles in water is not enough to make the bubbles microscopic, so the bubbles remain large and therefore it is difficult to generate microscopic bubbles.

Accordingly, various methods have been proposed in recent years, as follows, in order to generate microscopic bubbles:

(1) Generating microscopic bubbles by rapidly ejecting liquid from a nozzle and mix gas into the liquid. (For example, see Patent Document 1)

(2) Generating microscopic bubbles by stirring/shearing a mixture gas by generating rotational flow in liquid in a container. (For example, see Patent Document 2)

(3) Generating microscopic bubbles by making a gas-liquid mixture collide with a baffle or collision projections of a static mixer and stirring it. (For example, see Patent Document 3)

(4) Generating microscopic bubbles by dissolving gas in liquid by mixing and pressurizing the liquid and the gas, and then depressurizing the gas-liquid mixture. (For example, see Patent Document 4)

However, the methods of (1) to (3) of the prior art have the following problems:

The case (1) needs fine adjustment for achieving an optimal mixture of liquid and gas and is used only for small equipment, so it is difficult to generate a large amount of microscopic bubbles in a short time.

The case (2) needs fine adjustment for stably generating microscopic bubbles, so it has difficulty in operating for a long time without a worker. Further, a cyclone type turning mechanism having a spiral inflow channel is used, so it depends on a turning force by kinetic energy of liquid. Therefore, energy is insufficient and a sufficient turning force cannot be achieved, making it difficult to generate a large amount of microscopic bubbles in a short time.

The case (3) depends on simple collision, so bubbles cannot be made sufficiently microscopic. Further, a loss of energy due to resistance of the static mixer is large, and there is a need for power for sending a gas-liquid mixture to compensate the loss.

On the other hand, the case (4) includes a gas-liquid dissolving tank, as shown in FIG. 23, and generates microscopic bubbles by dissolving gas in contact with liquid under pressure using the tank, and then depressurizing or exposing it to atmosphere. Therefore, it requires only limited fine adjustment and is relatively easy to achieve operation control, as compared with the methods (1) to (3). However, in order to generate a large amount of bubbles in a short time, it is required to promote dissolution by increasing the contact area between the gas and the liquid in the gas-liquid dissolving tank, so the equipment of the gas-liquid dissolving tank increases in size and a high cost is required.

As a solution, there has been proposed a method of increasing a contact area of gas and liquid by making a channel in a zigzag shape, using shelf-shaped separation walls 14, 15, and 16 in a gas-liquid dissolving tank 3, as shown in FIGS. 24 to 26 (for example, see Patent Document 5), but this method still has a limit in promoting dissolution. This is because the method is supposed to make an ideal state in which gas flows through an upper portion and liquid flows through a lower portion anywhere in the channel, that is, the states shown in FIGS. 24 and 25, but actually, the ideal state cannot be maintained and the balance breaks after all, so most part of the channel is easy to submerge under the water level L, as in FIG. 26. In this case, the separation walls under the water level L have no meaning, so it is little different from the gas-liquid dissolving tank of FIG. 23. In order to prevent the submerging, it is required to control liquid to flow in an appropriate amount anywhere in the channel with a space left over the liquid by making a flow rate adjustable at predetermined portions in the channel, for example, at the openings 14*m*, 15*m*, and 16*m* of the separation walls, and as a result, the cost increases and a practical equipment cannot be achieved.

As described above, not only the cases (1) to (3) of the prior art, but the case (4) of the prior art has a limit in respect of both cost and performance

DOCUMENTS OF PRIOR ART

Patent Documents

Patent Document 1: JP, 2001-58142, A
Patent Document 2: JP, H10-230150, A
Patent Document 3: JP, 2002-85949, A
Patent Document 4: JP, H11-207162, A
Patent Document 5: JP, H7-328402, A

SUMMARY OF THE INVENTION

Problems to be Solved by the Invention

An object of the present invention is to achieve a microscopic bubble generator that can stably and efficiently generate a large amount of microscopic bubbles in liquid in a short time with a simple configuration, can be manufactured in both small and large sizes at a low cost because the structure is simple, and can be easily operated with high performance, and a gas-liquid dissolving tank that can be very suitably used for the apparatus.

Further, the microscopic bubble generator should be easy to clean, when it is applied to a process of handling food/beverage or high-purity liquid. In general, an apparatus used for this purpose is necessarily supposed to have, as a sanitary condition, a structure that has a flat liquid contact surface and be capable of being simply cleaned in an assembled state and in a disassembled state and simply reassembled. If the structure of the apparatus is complicated or there is a narrow portion in a channel, it is difficult to completely clean the liquid contact portions in an assembled state and it is troublesome to clean it in a disassembled state, and clogging is easily caused by liquid mixed with solid or particles.

Accordingly, another object of the present invention is to achieve a microscopic bubble generator that can be easily cleaned in an assembled state and a disassembled state even in a process of handling food/beverage or high-purity liquid, satisfying a sanitary condition, can be used without clogging, and can be applied to various usages or various liquids, and a gas-liquid dissolving tank that can be very suitably used for the apparatus.

Means for Solving the Problems

In order to achieve the objects, the present invention provides a gas-liquid dissolving tank that promotes dissolution of gas mixed with liquid in the liquid, in which openings that pass the flowing gas-liquid are formed at an upper portion and a lower portion of a container of the tank, a plurality of separation walls that vertically divide a plurality of chambers are disposed in the container, openings that connect upper and lower chambers are formed through the separation walls, the upper ends of the openings of the separation walls extend predetermined distances upward from the separation walls, and the lower ends of the openings of the separation walls extend predetermined distances downward from the separation walls.

In the present invention, the upper end of the opening of a separation wall may be positioned above the lower end of the opening of another separation wall right above the separation wall.

Further, the shape of the upper end of the opening of the separation wall and/or the separation wall facing the upper end may be formed such that ejection flow from the upper end of the opening of the separation wall is substantially horizontally dispersed or diffused, when the flowing gas-liquid flows upward.

Further, an exhaust mechanism for discharging non-dissolved gas accumulated in the container may be provided.

Further, there may be provided a microscopic bubble generator that includes: a pumping unit that pumps liquid; a gas mixing unit that mixes gas with the liquid; a gas-liquid dissolution promoting unit that promotes dissolution of gas-liquid; and a gas-liquid discharging unit that discharges the gas-liquid through a channel, and that uses the gas-liquid dissolving tank of any one of the foregoing as the gas-liquid dissolution promoting unit.

Further, an exhaust mechanism for discharging non-dissolved gas accumulated in the gas-liquid dissolving tank may be provided in the gas-liquid dissolving tank, and may have an exhaust opening that communicates with a gas inlet of the gas mixing unit.

Further, a sensing unit that senses the degree of accumulation of non-dissolved gas in the gas-liquid dissolving tank may be provided in the gas-liquid dissolving tank, and the amount of gas flowing in the gas mixing unit may be throttled and adjusted in accordance with the sensed degree of accumulation.

Further, the gas-liquid discharging unit may discharge the gas-liquid through at least one process of passing a throttled channel, passing a narrow gap, rapidly changing direction, and rapidly turning.

Further, the gas-liquid discharging unit may have a container body having a bottom that is open and tapered, and having a substantially conical empty portion from the point to the opening, and a container cover spaced at a predetermined gap from the inner wall of the empty portion and covering the other portion of the empty portion; an inlet channel for taking gas-liquid inside in a circumferential tangential direction of the inner wall of the empty portion through the container body may be formed around a large-diameter portion of the space defined between the container body and the container cover; and an outlet channel for discharging gas-liquid outside through the container cover may be formed around the point in the space defined between the container body and the container cover.

Further, the present invention provides a microscopic bubble generator that includes: a pumping unit that pumps liquid; a gas mixing unit that mixes gas with the liquid; and a gas-liquid discharging unit that discharges the gas-liquid through a channel, in which the gas-liquid discharging unit has a container body having a bottom that is open and tapered, and having a substantially conical empty portion from the point to the opening, and a container cover spaced at a predetermined gap from the inner wall of the empty portion and covering the other portion of the empty portion, an inlet channel for taking gas-liquid inside in a circumferential tangential direction of the inner wall of the empty portion through the container body is formed around a large-diameter portion of the space defined between the container body and the container cover, and an outlet channel for discharging gas-liquid outside through the container cover is formed around the point in the space defined between the container body and the container cover.

Effect of the Invention

According to the present invention, the apparatus can stably/efficiently generate a large amount of microscopic bubbles in liquid in a short time with a simple configuration, can be completely cleaned at liquid contact portions in an assembled state, can be easily cleaned in a disassembled state and easily reassembled, can be used without clogging, and can be applied to various liquids such as food/beverage or high-purity liquid.

DESCRIPTION OF THE PREFERRED EMBODIMENTS

Figure 1:
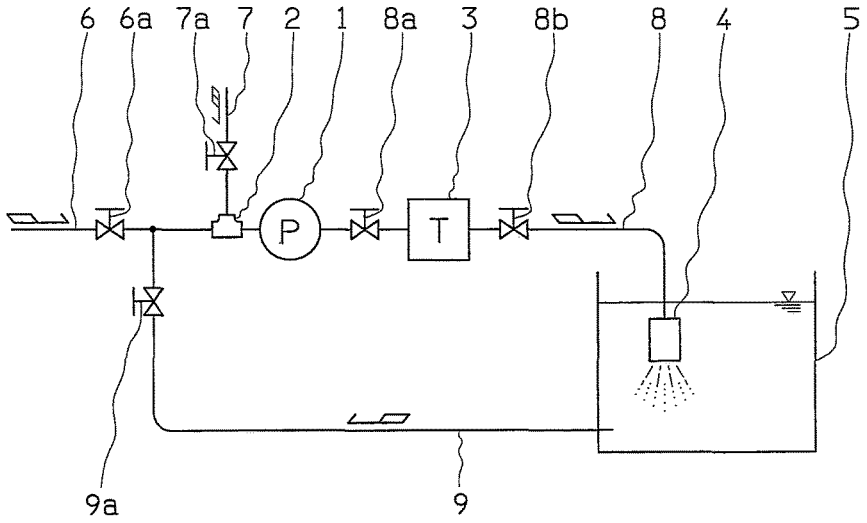
FIG. 1 is an illustrative view showing an example of the configuration of a microscopic bubble generator.

Hereinafter, like reference symbols are given to like components in the drawings, and embodiments of the present invention will be described in detail.

Embodiment 1

FIG. 1 is an illustrative view showing an example of the configuration of a microscopic bubble generator and shows basic components and their coupling circuits in embodiments to be described hereafter. That is, the microscopic bubble generator includes a pumping unit 1 for pumping liquid, a gas mixing unit 2 for mixing gas with liquid, a gas-liquid dissolution promoting unit 3 for promoting dissolution of the gas in liquid, and a gas-liquid discharging unit 4 for discharging the dissolved gas-liquid to a reservoir 5 through a channel. Pipes 6, 7, 8, and 9 are pipes connecting the units, and the pipes can be opened/closed and the flow rate in the pipes can be adjusted by valves 6*a*, 7*a*, 8*a*, 8*b*, and 9*a*. Gas flows through the pipe 7 and liquid is supplied from an external supplier through the pipe 6, so they join each other at the gas mixing unit 2, but the liquid in the reservoir 5 may be circulated through the pipe 9.

In this figure, the pumping unit 1 is a self-priming pump and the gas mixing unit 2 is disposed at the upstream side from the pumping unit 1, so a simple configuration that takes gas with liquid using a self-priming force of the pump and mixes them is exemplified. In this case, there is the advantage that gas and liquid are mixed even in the self-priming pump Also, the pumping unit 1 may be a non-self-priming pump, the gas mixing unit 2 may be disposed at the downstream side from the pumping unit 1, and gas may be injected by a compressor or an ejector (a venturi tube).

Figure 2:
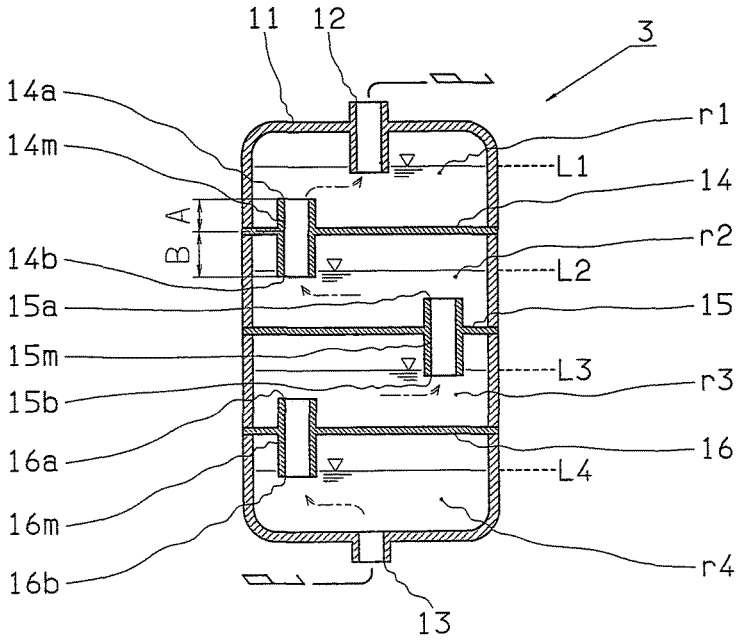
FIG. 2 is a longitudinal cross-sectional view of a gas-liquid dissolving tank of a first embodiment of the present invention, showing an operation state in case that flowing gas-liquid flows upward.
Figure 3:
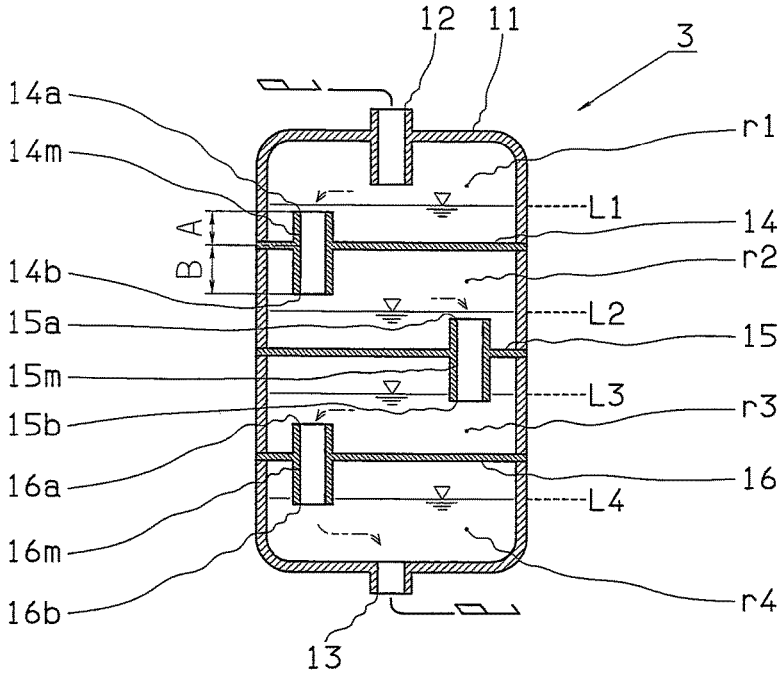
FIG. 3 is a longitudinal cross-sectional view of the gas-liquid dissolving tank of the first embodiment of the present invention, showing an operation state in case that flowing gas-liquid flows downward.

FIGS. 2 and 3 are longitudinal cross-sectional view of a gas-liquid dissolving tank of a first embodiment of the present invention, and the tank may be very suitably used as the gas-liquid dissolution promoting unit 3 in the microscopic bubble generator described above. FIG. 2 shows an operation state in case that flowing gas-liquid flows upward, and FIG. 3 shows an operation state in case that flowing gas-liquid flows downward.

The gas-liquid dissolving tank 3 has a configuration that is very suitable for promoting dissolution of gas mixed with liquid in the liquid. In detail, a container 11 has openings 12 and 13 at an upper portion and a lower portion for passing the flowing gas-liquid and has separation walls 14, 15, and 16 forming parallel chambers r1, r2, r3, and r4 in the up-down direction therein. An opening 14*m* connecting the chamber r1 and the chamber r2 over and under the separation wall 14 is formed through the separation wall 14, the upper end 14*a* of the opening extends a predetermined distance A upward from the separation wall 14, and the lower end 14*b* of the opening extends a predetermined distance B downward from the separation wall 14. Similarly, an opening 15*m* connecting the chambers r2 and r3 over and under the separation wall 15 is formed through the separation wall 15, the upper end 15*a* and the lower end 15*b* of the opening extend predetermined distances from the separation wall 15. Further, an opening 16*m* connecting the chambers r3 and r4 over and under the separation wall 16 is formed through the separation wall 16 and the upper end 16*a* and the lower end 16*b* of the opening extend predetermined distances from the separation wall 16.

In the drawings, although the separation walls are provided at three positions for the convenience of description, the number of the separation walls is not limited to three.

When the gas-liquid dissolving tank of the first embodiment is the gas-liquid dissolution promoting unit 3 of the microscopic bubble generator in FIG. 1 and the apparatus is operated with the flowing gas-liquid flowing upward to a container opening 12 at the upper portion from a container opening 13 at the lower portion of the container 11, the flowing gas-liquid flows in the state shown in FIG. 2. That is, the gas and liquid flow through the chambers r4, r3, r2, and r1 by flowing upward gently through the separation wall openings 16*m*, 15*m*, and 14*m* that are channels having a sufficient area, in which the gas and the liquid are separated up and down by the difference in specific gravity, so the gas flows toward the upper chambers earlier than the liquid.

However, since the separation wall opening lower ends 16*b*, 15*b*, and 14*b* extend predetermined distances downward from the separation walls, the gas cannot flow to the upper chambers unless it gets over the ends. Thus the gas collects on the ceilings of the separation walls 16, 15, and 14, so liquid levels L4, L3, and L2 are formed in the chambers r4, r3, and r2, respectively. This means that none of the separation walls 16, 15, and 14 are submerged as long as there is non-dissolved gas in the liquid. Further, in the example shown in the figure, the lower end of the container opening 12 extends a predetermined distance downward from the ceiling of the container 11, so the same effect as those in the other chambers is generated in the chamber r1, so a liquid level L1 is formed.

As described above, the gas and the liquid exist at the upper portion and the lower portion, respectively, and the liquid levels L4, L3, L2, and L1 are formed in the chambers r4, r3, r2, and r1 without any of the separation walls 16, 15 and 14 submerging, so the gas-liquid contact areas increase in the gas-liquid dissolving tank 3. Accordingly, gas-liquid dissolution for generating a large amount of microscopic bubbles in a short time is efficiently promoted.

On the other hand, when the apparatus is operated such that the flowing gas-liquid flows downward to the container opening 13 at the lower portion from the container opening 12 at the upper portion of the container 11, the flowing gas-liquid flows in the state shown in FIG. 3. That is, the gas and liquid flow through the chambers r1, r2, r3, and r4 by flowing downward gently through the separation wall openings 14*m*, 15*m*, and 16*m* that are channels having a sufficient area, in which the gas and the liquid are separated up and down by the difference in specific gravity, so the gas flows toward the upper chambers against the flow of the liquid. However, since the separation wall opening lower ends 14*b*, 15*b*, and 16*b* extend predetermined distances downward from the separation walls, the gas cannot flow to the upper chambers unless it gets over the ends. Thus the gas collects on the ceilings of the separation walls 14, 15, and 16, so liquid levels L2, L3, and L4 are formed in the chambers r2, r3, and r4, respectively. This means that none of the separation walls 14, 15, and 16 are submerged as long as there is non-dissolved gas in the liquid. Further, in the example shown in the figure, the lower end of the container opening 12 extends a predetermined distance downward from the ceiling of the container 11, so the same effect as those in the other chambers is generated in the chamber r1, and a liquid level L1 is formed.

Further, when the flowing gas-liquid flows downward and the non-dissolved gas is accumulated, the thickness of the gas layer (distance from a liquid level to the separation wall over it) increases, and consequently, the gas pushes down the liquid in the chamber toward the lower chamber. However, since the separation wall opening upper ends 14*a*, 15*a*, and 16*a* extend predetermined distances upward from the separation walls, the liquid cannot flow to the lower chambers unless it gets over the ends. Thus the liquid collects on the bottoms of the separation walls 14, 15, and 16, so liquid levels L1, L2, and L3 are formed in the chambers r1, r2 and r3, respectively. This means that none of the separation walls 14, 15, and 16 dry out, no matter how much the non-dissolved gas in the liquid increases.

In FIG. 3, liquid levels L3 and L4 due to separation wall opening lower ends and liquid levels L1 and L2 due to separation wall opening upper ends are shown, for the convenience of description.

As described above, the gas and the liquid exist at the upper portion and the lower portion, respectively, and the liquid levels L1, L2, L3, and L4 are formed in the chambers r1, r2, r3, and r4 without any of the separation walls 14, 15 and 16 submerging or drying out, so the gas-liquid contact areas increase in the gas-liquid dissolving tank 3. Accordingly, gas-liquid dissolution for generating a large amount of microscopic bubbles in a short time is efficiently promoted.

According to this apparatus, since the liquid levels L1, L2, L3, and L4 are formed by the difference in specific gravity of gas and liquid and the separation wall opening upper ends and lower ends regardless of whether the flowing gas-liquid flows upward or downward in the container 11, the thickness of the gas layer (distance from a liquid level to the separation wall over it) is large when gas-liquid dissolution does not proceed, but it decreases when gas-liquid dissolution proceeds, and when the thickness of the layer becomes zero, that is, when the separation walls submerge, it means that gas-liquid dissolution is completely performed. Accordingly, the thickness of the layer is naturally determined in accordance with the degree of gas-liquid dissolution, so the apparatus can be automatically operated without a control mechanism or a control operation for controlling the liquid level in order to ensure a stable gas-liquid contact area, and accordingly, it is very convenient.

As described above, the apparatus is a simple and compact apparatus based on the clear principle of ensuring a gas-liquid contact in a layered shape, using the difference in specific gravity of gas and liquid, the apparatus can be easily manufactured and the reliability and durability are high. Further, it may become easy to further increase the gas-liquid contact area by increasing the number of separation walls.

Further, the distances that the separation wall opening upper ends and lower ends extend from the separation walls (distances indicated by "A" and "B" in the drawings) are not necessarily the same in each separation wall, and for example, they may extend shorter as the separation wall is positioned closer to the downstream side in the container 11 in consideration of channel resistance. Further, when the flow direction in the container 11 is limited to the upward direction, only the lower ends of the separation wall opening upper/lower ends may extend from the separation walls.

The apparatus has a structure that can be easily cleaned in an assembled state or in a disassembled state, satisfying a sanitary condition, so it can be used for various usages and various liquids.

The gas-liquid dissolving tank 3 has no narrow portion, and gas and liquid only need to pass gently through the separation wall openings 14*m*, 15*m*, and 16*m*, which are channels having a sufficient area, so clogging hardly occurs, and it is possible to simply clean every hook and corner of the apparatus. Though not shown, in order that the apparatus can be cleaned in operation without disassembling, and in order that remaining liquid can be discharged, appropriate number of cleaning liquid injection holes, cleaning nozzles, drains, etc., may be formed at appropriate positions in the container 11. Further, when the container 11 is formed by stacking and fastening separation wall members, the portions around the separation walls are all exposed when the container is disassembled, so the liquid contact portions can be completely cleaned, and reassembling is also easy.

The apparatus is used not only for efficiently dissolving gas such as air, oxygen, carbon dioxide, and ozone by making microscopic bubbles in various liquids such as water, food, beverage, oil, and chemical products, but also for using microscopic bubbles of non-dissolved gas in fields such as cosmetic treatment, healthcare, cleaning, and wastewater treatment, or for using various liquids in a foam or a cream state by diffusing microscopic bubbles in the liquids such as foods and cosmetics, making it applicable to various fields.

Embodiment 2

Figure 4:
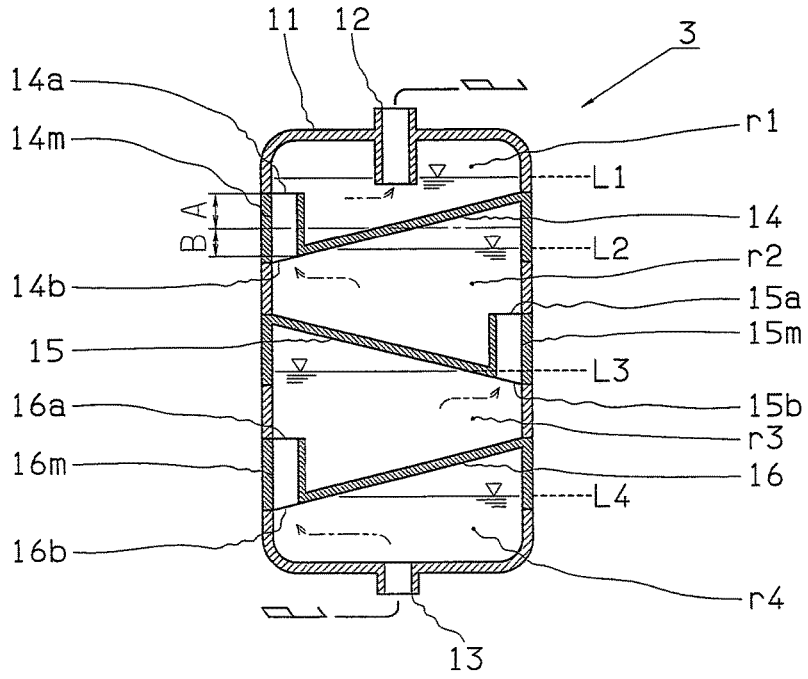
FIG. 4 is a longitudinal cross-sectional view of a gas-liquid dissolving tank of a second embodiment of the present invention, showing an operation state in case that flowing gas-liquid flows upward.
Figure 5:
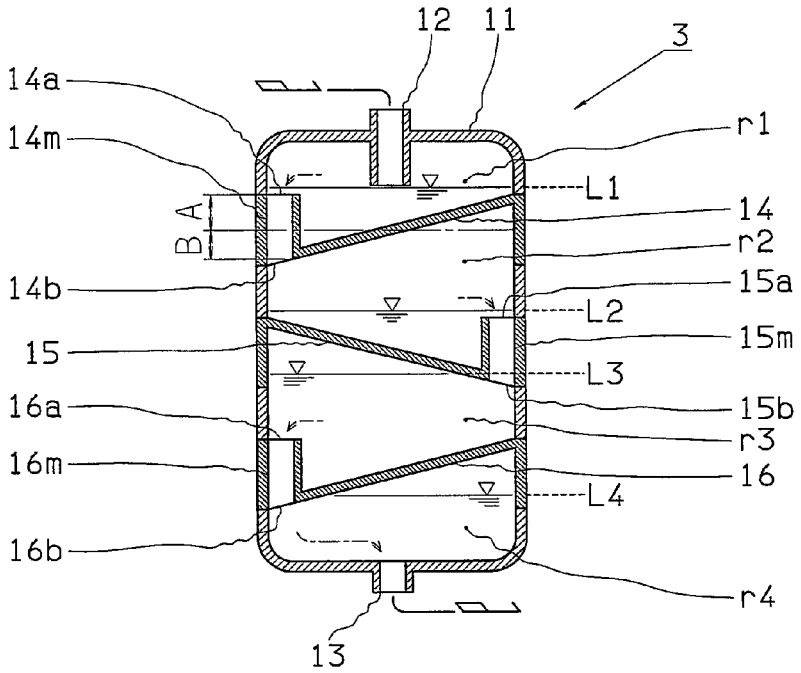
FIG. 5 is a longitudinal cross-sectional view of the gas-liquid dissolving tank of the second embodiment of the present invention, showing an operation state in case that flowing gas-liquid flows downward.

FIGS. 4 and 5 are longitudinal cross-sectional view of a gas-liquid dissolving tank of a second embodiment of the present invention. FIG. 4 shows an operation state in case that flowing gas-liquid flows upward, and FIG. 5 shows an operation state in case that flowing gas-liquid flows downward.

In this embodiment, as a modification of the separation walls 14, 15, and 16 of the first embodiment, separation walls are inclined, and the positions of separation wall opening upper ends 14*a*, 15*a*, and 16*a* and lower ends 14*b*, 15*b*, and 16*b* are adjusted accordingly.

Other configuration and functions of this embodiment are the same as those of the first embodiment.

Embodiment 3

Figure 6:
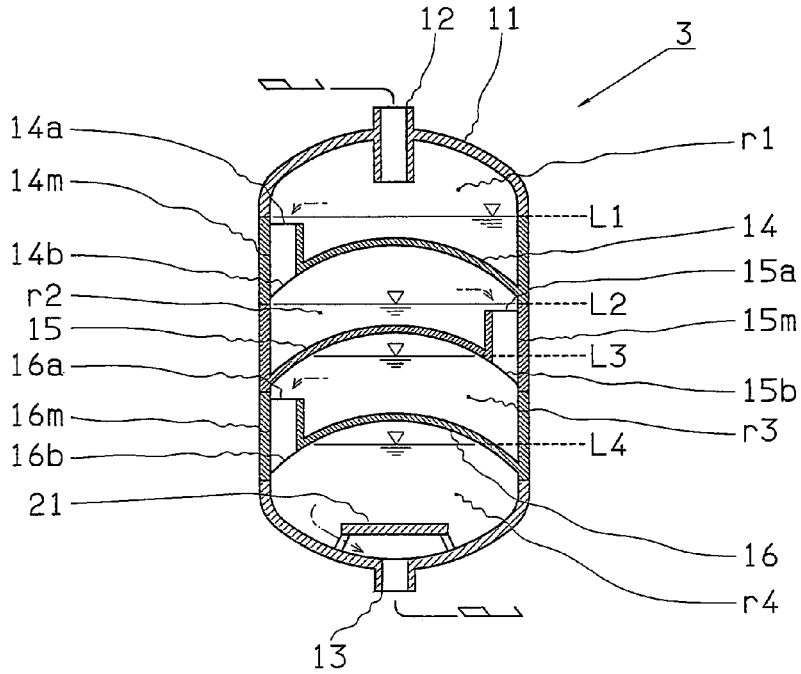
FIG. 6 is a longitudinal cross-sectional view showing a gas-liquid dissolving tank of a third embodiment of the present invention.

FIG. 6 is a longitudinal cross-sectional view showing a gas-liquid dissolving tank of a third embodiment of the present invention, and shows an operation state in case that flowing gas-liquid flows downward.

In this embodiment, as a modification of the separation walls 14, 15, and 16 of the first embodiment, separation walls are convex upward, and the positions of separation wall opening upper ends 14*a*, 15*a*, and 16*a* and lower ends 14*b*, 15*b*, and 16*b* are adjusted accordingly. Further, an example of additionally providing a baffle 21 for preventing non-dissolved gas from being pushed to the downstream side by flow is shown.

Other configuration and functions of this embodiment are the same as those of the first embodiment.

Embodiment 4

Figure 7:
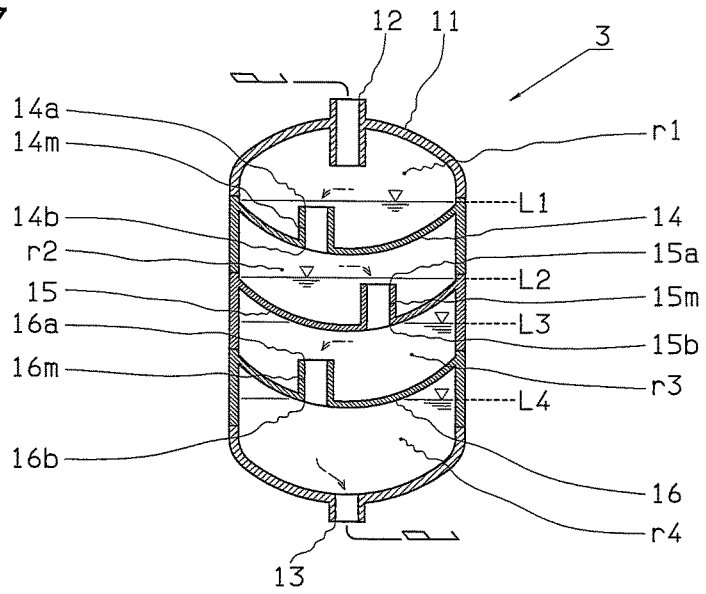
FIG. 7 is a longitudinal cross-sectional view showing a gas-liquid dissolving tank of a fourth embodiment of the present invention.

FIG. 7 is a longitudinal cross-sectional view showing a gas-liquid dissolving tank of a fourth embodiment of the present invention, and shows an operation state in case that flowing gas-liquid flows downward.

In this embodiment, as a modification of the separation walls 14, 15, and 16 of the first embodiment, separation walls are convex downward, and the positions of separation wall opening upper ends 14*a*, 15*a*, and 16*a* and lower ends 14*b*, 15*b*, and 16*b* are adjusted accordingly.

Other configuration and functions of this embodiment are the same as those of the first embodiment.

Embodiment 5

Figure 8:
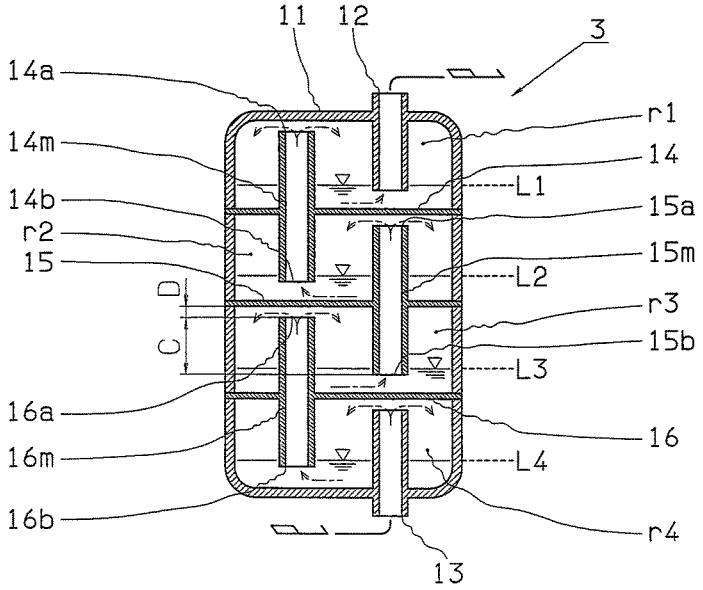
FIG. 8 is a longitudinal cross-sectional view showing a gas-liquid dissolving tank of a fifth embodiment of the present invention.

FIG. 8 is a longitudinal cross-sectional view showing a gas-liquid dissolving tank of a fifth embodiment of the present invention, and shows an operation state in case that flowing gas-liquid flows upward.

In the relationship of the openings of the separation walls 14, 15, and 16 in this embodiment, the upper end of the opening of a separation wall is positioned above the lower end of the opening of another separation wall right above the separation wall, so the upper end of the opening of the separation wall is exposed in a non-dissolved gas layer over the liquid level in the chamber, and liquid is ejected into the non-dissolved gas layer, and accordingly, the gas-liquid contact area is further increased. For example, the upper end 16*a* of the opening of the separation wall 16 is positioned at a distance C above the lower end 15*b* of the opening of the separation wall 15 right above the separation wall 16. The distance D between the separation wall opening upper end 16*a* and the separation wall 15 right above it may be as small as possible without interfering with the flow of gas-liquid. In the operation with the flowing gas-liquid flowing upward, when there is a large amount of non-dissolved gas (that is, when gas-liquid dissolution needs to be further promoted), a layer of non-dissolved gas is formed under the separation wall 15 due to the effect of the separation wall opening lower end 15*b* and a liquid level L3 is formed in the chamber r3, while the separation wall opening upper end 16*a* is positioned above the liquid level L3, so it is exposed in the non-dissolved gas layer. Accordingly, liquid ejected from the separation wall opening upper end 16*a* is exposed to the non-dissolved gas, and the gas-liquid contact area increases, and thus the gas-liquid dissolution is naturally promoted.

This configuration may be applied to any one of the separation wall openings 14*m*, 15*m*, and 16*m*, and in FIG. 8, this configuration is applied to all the separation wall openings 14*m*, 15*m*, and 16*m*, and container openings 12 and 13 are also configured in this way.

As described above, in this embodiment, it is possible to achieve the operation effect of the first to fourth embodiments, and in addition, particularly when the flowing gas-liquid flows upward, the contact area of the ejected liquid and the non-dissolved gas increases because the separation wall opening upper ends are exposed in the non-dissolved gas layers over the liquid levels, and gas-liquid dissolution is naturally further promoted.

Other configuration and functions of this embodiment are the same as those of the first embodiment.

Embodiment 6

Figure 9:
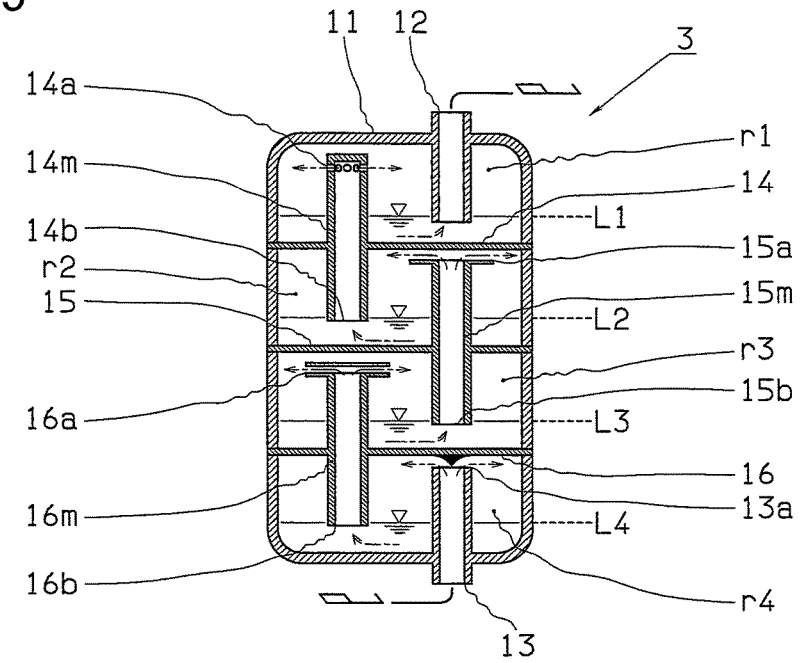
FIG. 9 is a longitudinal cross-sectional view showing a gas-liquid dissolving tank of a sixth embodiment of the present invention.
Figure 10:
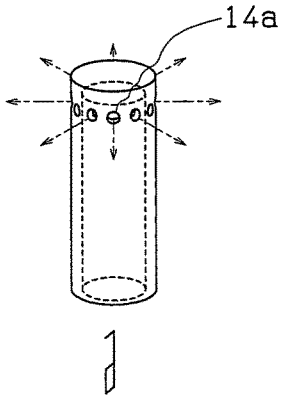
FIG. 10 is a perspective view showing an example of the shape of an opening of a separation wall in FIG. 9.
Figure 11:
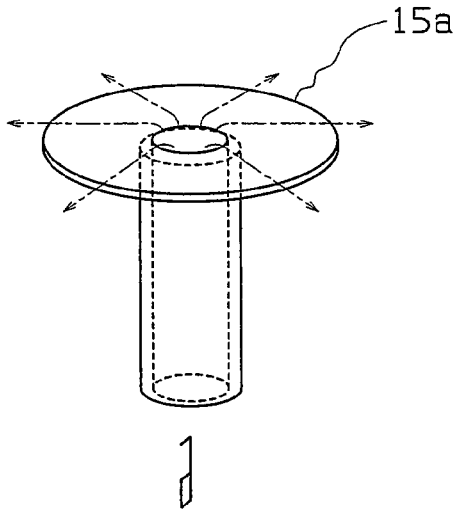
FIG. 11 is a perspective view showing an example of the shape of an opening of a separation wall in FIG. 9.
Figure 12:
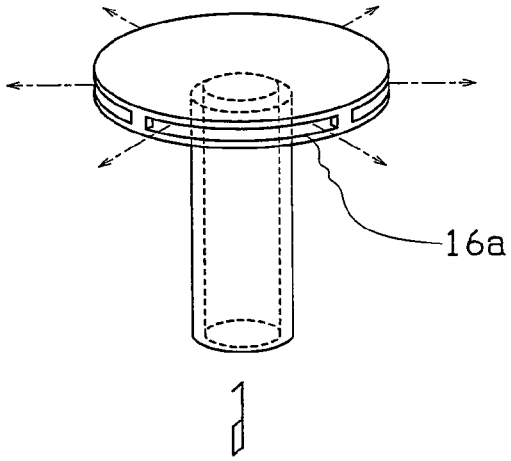
FIG. 12 is a perspective view showing an example of the shape of an opening of a separation wall in FIG. 9.

FIG. 9 is a longitudinal cross-sectional view showing a gas-liquid dissolving tank of a sixth embodiment of the present invention, and shows an operation state in case that flowing gas-liquid flows upward. FIGS. 10, 11, and 12 are perspective views showing examples of the shape of a separation wall opening in FIG. 9.

According to this embodiment, in those of the fifth embodiment, the shapes of the separation wall opening upper ends 14*a*, 15*a*, and 16*a* and/or the separation walls facing them are formed such that ejection flow from the separation wall opening upper ends 14*a*, 15*a*, and 16*a* is substantially horizontally dispersed or diffused, when the flowing gas-liquid flows upward. Various available shapes of the separation wall opening upper ends are shown, that is, the separation wall opening upper end 14*a* is formed in a shower nozzle shape, the separation wall opening upper end 15*a* has a slit between a disc-shaped opening and the separation wall 14, and the separation wall opening upper end 16*a* has slits formed by two discs at the opening.

Further, like the upper end 13*a* of the container opening 13, the same effect can be achieved by simply decreasing the distance from the separation wall 16 and making a peripheral channel smooth.

In this embodiment, it is made sure that ejection flow from the separation wall opening upper ends is substantially horizontally dispersed or diffused and ejected like a shower or in the shape of a very thin layer, so the contact area of the ejected liquid and the non-dissolved gas is further increased than that of the fifth embodiment, thus further promoting gas-liquid dissolution.

Other configuration and functions of this embodiment are the same as those of the fifth embodiment.

Embodiment 7

Figure 13:
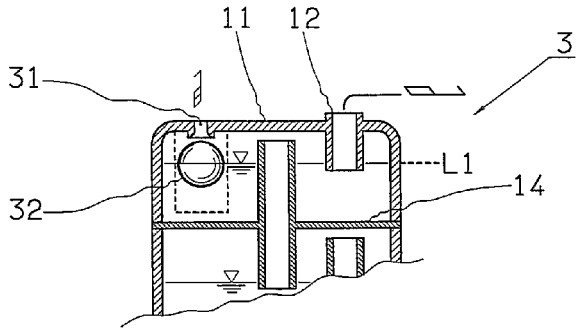
FIG. 13 is a longitudinal cross-sectional view showing main parts of a gas-liquid dissolving tank of a seventh embodiment of the present invention.

FIG. 13 is a longitudinal cross-sectional view showing main parts of a gas-liquid dissolving tank of a seventh embodiment of the present invention.

In this embodiment, an exhaust mechanism for discharging non-dissolved gas accumulated in the gas-liquid dissolving tank 3 is provided. Even though gas-liquid dissolution efficiency is improved by the gas-liquid dissolving tank 3, when non-dissolved gas remains, it may make large bubbles, flow out through the downstream side, and interfere with generation of microscopic bubbles, so the exhaust mechanism is provided as a protective measure to prevent it. In detail, for example, a simple float valve type in which a float 32 is disposed in the uppermost chamber in the container 11, and when gas is accumulated over a predetermined amount, the liquid level L1 drops and a valve port 31 opens is exemplified, but the present invention is not limited thereto and a structure that releases gas when the gas is accumulated over a predetermined amount may be used.

Other configuration and functions of this embodiment are the same as those of the embodiments described above.

Embodiment 8

Figure 14:
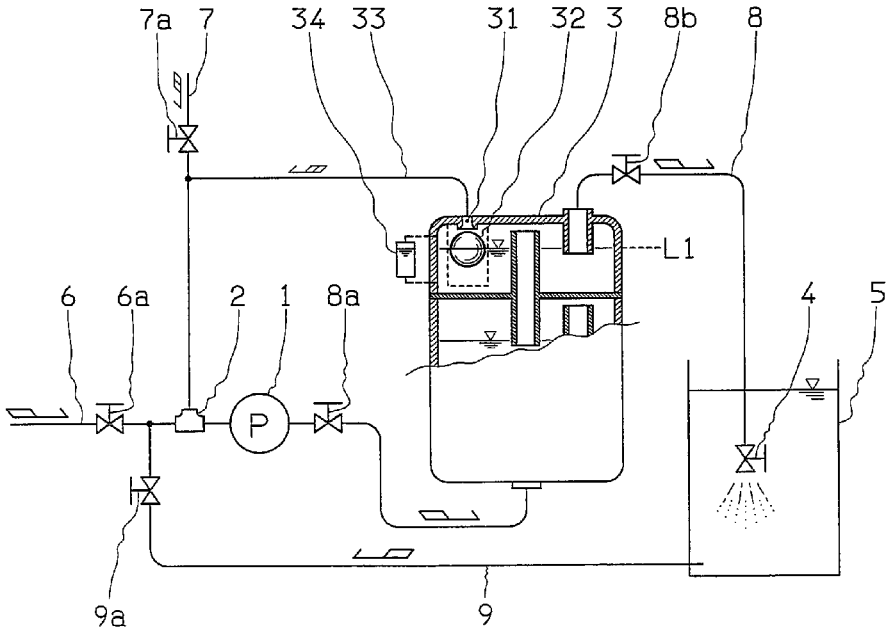
FIG. 14 is an illustrative view (partial cross-sectional view) showing a microscopic bubble generator of an eighth embodiment of the present invention.

FIG. 14 is an illustrative view (partial cross-sectional view) showing a microscopic bubble generator of an eighth embodiment of the present invention.

In this embodiment, an exhaust mechanism for discharging non-dissolved gas accumulated in the gas-liquid dissolving tank 3, as in the seventh embodiment, is put in the circuit of the microscopic bubble generator shown in FIG. 1, so exhaust gas is efficiently reused and the non-dissolved gas accumulated in the gas-liquid dissolving tank 3 is automatically suppressed under a predetermined amount. In detail, a valve port 31 of the exhaust mechanism communicates with a gas inlet of the gas mixing unit 2 through a pipe 33, so when gas is accumulated over a predetermined amount, the float 32 is separated from the valve port 31 and the gas naturally flows to the upstream side from the gas-liquid dissolving tank 3. Accordingly, the non-dissolved gas in the gas-liquid dissolving tank 3 is automatically controlled to be accumulated under a predetermined amount.

In this figure, it is shown that the operation becomes convenient by appropriately adding a level gauge 34 for measuring the amount of accumulated gas.

Further, the microscopic bubble generator equipped with the gas-liquid dissolving tank 3 of the present invention generates microscopic bubbles by depressurizing and discharging a gas-liquid mixture after sufficiently bringing the gas into contact with the liquid and dissolving the gas, and to this end, a simple throttling type that discharges gas-liquid by throttling a channel is exemplified as the gas-liquid discharging unit 4. When there is no need for fine adjustment in the gas-liquid discharge, a fixed orifice or a reducer may be used instead of the throttling type.

Other configuration and functions of this embodiment are the same as those of the embodiments described above.

Embodiment 9

Figure 15:
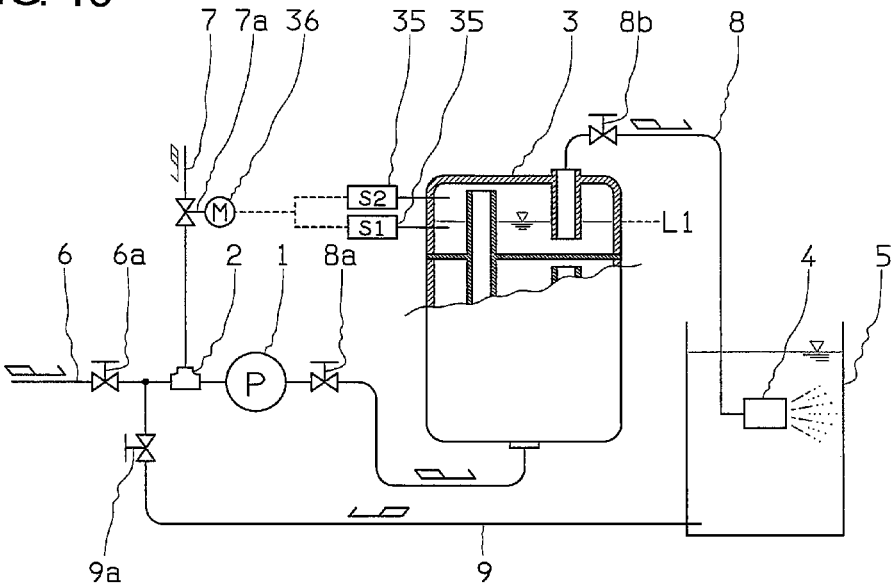
FIG. 15 is an illustrative view (partial cross-sectional view) showing a microscopic bubble generator of a ninth embodiment of the present invention.

FIG. 15 is an illustrative view (partial cross-sectional view) showing a microscopic bubble generator of a ninth embodiment of the present invention.

This embodiment provides another method of automatic control for suppressing non-dissolved gas accumulated in the gas-liquid dissolving tank 3 under a predetermined amount, in which a sensor 35 that senses the degree of accumulation of non-dissolved gas in the gas-liquid dissolving tank 3 is provided in the gas-liquid dissolving tank, so the amount of gas flowing in the gas mixing unit 2 is throttled and adjusted in accordance with the sensed degree of accumulation. In detail, there are provided a sensor S1 and a sensor S2 that determine a lower limit and an upper limit, respectively, of the vertical change of the liquid level L1 in the uppermost chamber in the container 11, a signal processor (not shown) converts a sensor signal from the sensors into a valve driving signal and drives a driving unit 36 for gas intake valve 7*a*, so the amount of gas taken inside from the outside through the pipe 7 is controlled. Accordingly, when the non-dissolved gas is accumulated in the gas-liquid dissolving tank 3 and the liquid level L1 drops to the sensor S1, the amount of gas taken inside through the valve 7*a* is reduced and the remaining non-dissolved gas is dissolved. On the other hand, when the non-dissolved gas stops being accumulated and the liquid level L1 rises to the sensor S2, the valve 7*a* opens and more gas is taken inside.

Accordingly, the non-dissolved gas accumulated in the gas-liquid dissolving tank 3 is suppressed under a predetermined amount and automatic control is performed so that gas is taken inside as much as possible, making complete automatic operation possible, which is very convenient.

In this embodiment, the process of driving the valve 7*a* by sensing the degree of accumulation of the non-dissolved gas is electrically performed, but it may be mechanically performed.

Further, the gas-liquid discharging unit 4 not only discharges gas-liquid by simply throttling the channel, but stably and efficiently generates a large amount of microscopic bubbles in liquid in a short time with its own capability to discharge gas-liquid more efficiently. The details will be described below.

Other configuration and functions of this embodiment are the same as those of the eighth embodiment.

Embodiment 10

Figure 16:
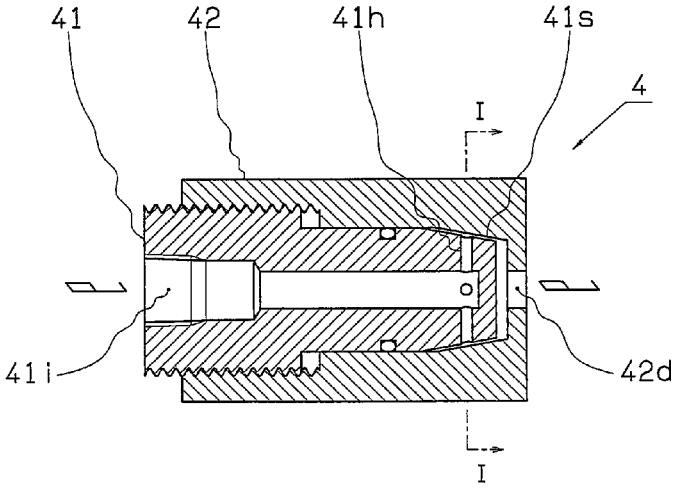
FIG. 16 is a longitudinal cross-sectional view showing a gas-liquid discharging unit of a tenth embodiment of the present invention.
Figure 17:
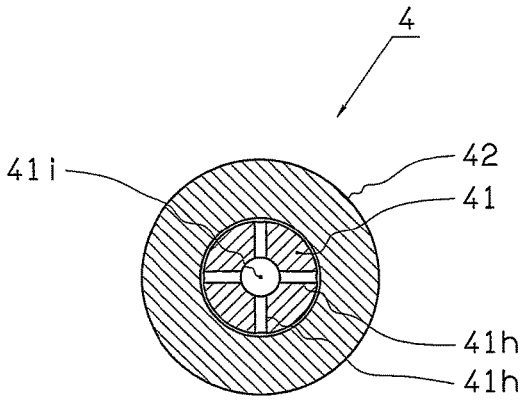
FIG. 17 is a cross-sectional view taken along line I-I in FIG. 16.

FIG. 16 is a longitudinal cross-sectional view showing a gas-liquid discharging unit of a tenth embodiment of the present invention, and FIG. 17 is a cross-sectional view taken along line I-I in FIG. 16.

This embodiment shows an example of the gas-liquid discharging unit 4 in the microscopic bubble generators according to the embodiments described above, in which gas-liquid is discharged by passing through a narrow gap and/or rapidly changing direction. In detail, a channel from an inlet channel 41*i* to an outlet channel 42*d* rapidly decreases in cross-sectional area and rapidly changes direction at a channel 41*h* or a channel 41*s* to depressurize the flowing gas-liquid and generate rapid turbulence, thereby promoting generation of microscopic bubbles. Accordingly, stable and efficient generation of microscopic bubbles is promoted by equipping the microscopic bubble generators of the embodiments described above with the gas-liquid discharging unit 4. Further, when the non-dissolved gas in the gas-liquid dissolving tank 3 flows out in large bubbles without being processed, they can be made microscopic by this unit 4.

Further, as in the figure, the container of the gas-liquid discharging unit 4 is, for example, divided into a container body 41 and a container cover 42 which can be adjusted in position from each other so that the cross-sectional areas and the channel shapes of the channels such as the channel 41*s* can be adjusted.

Embodiment 11

Figure 18:
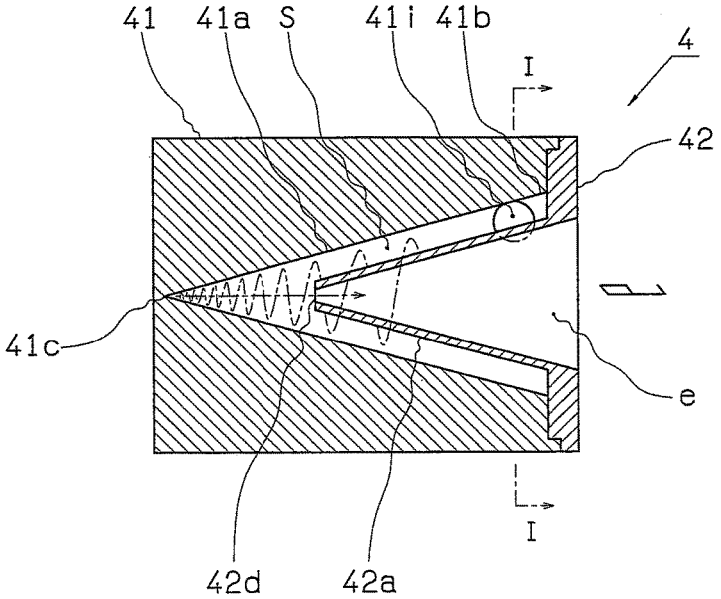
FIG. 18 is a longitudinal cross-sectional view showing a gas-liquid discharging unit of an eleventh embodiment of the present invention.
Figure 19:
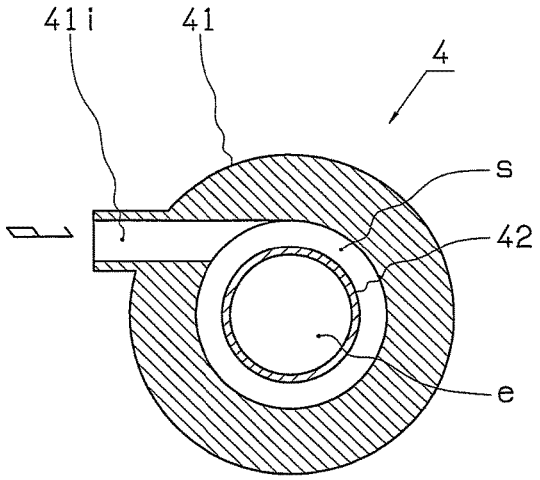
FIG. 19 is a cross-sectional view taken along line I-I in FIG. 18.

FIG. 18 is a longitudinal cross-sectional view showing a gas-liquid discharging unit of an eleventh embodiment of the present invention, and FIG. 19 is a cross-sectional view taken along line I-I in FIG. 18.

This embodiment shows another example of the gas-liquid discharging unit 4 in the microscopic bubble generators according to the embodiments described above, and it rapidly turns and discharges gas-liquid. In detail, the container of the gas-liquid discharging unit 4 is composed of a container body 41 and a container cover 42, the bottom 41*b* (the right cross-section in the figure) of the container body 41 is open and tapered, so it has a substantially conical empty portion s from the point 41*c* to the opening, and the container cover 42 is spaced at a predetermined gap from the inner wall 41*a* of the empty portion s and has a convex surface 42*a* covering the other portion of the empty portion.

An inlet channel 41*i* for taking in gas-liquid in a circumferential tangential direction of the inner wall 41*a* of the empty portion through the container body 41 is formed around the large-diameter portion of the space defined between the container body 41 and the container cover 42. Further, an outlet channel 42*d* for discharging gas-liquid outside through an outlet space e through the container cover 42 is formed around the point 41*c* in the space defined between the container body 41 and the container cover 42.

According to this configuration, gas-liquid flowing inside from the inlet channel 41*i* is efficiently blocked by the container cover 42 and maintained at a predetermined pressure, and it flows in the circumferential tangential direction of the inner wall 41*a* of the empty portion, so it turns along the inner wall 41*a* of the empty portion and flows toward the point 41*c* of the empty portion s, then the turning speed increases because the turning radius decreases, and accordingly, it turns at a high speed around the point 41*c*.

Next, the gas-liquid is ejected to the outlet space e from the outlet channel 42*d* of the container cover 42, which is opposite to the point 41*c*, but the outlet space e is in a static-water area in the reservoir 5, so the gas-liquid is rapidly depressurized almost to the atmospheric pressure and is exposed to a rapid change from a high-speed turning state to a non-turning state as soon as it is ejected to the outlet space e. Accordingly, bubbles are separated, and strong vortex and turbulence are generated by the rapid change from the high-speed turning state to the non-turning state, so the bubbles are stirred/sheared into a microscopic size.

According to this embodiment, since the outlet channel 42*d* is not formed at the point 41*c* of the empty portion s, but is positioned opposite to the point 41*c*, the size of the diameter of the outlet channel 42*d* does not interfere with the gas-liquid turning at higher speeds and the gas-liquid can turn at as high speed as possible, so microscopic bubbles can be generated more easily. Further, the diameter of the outlet channel 42*d* can be made relatively large, so it is possible to achieve the gas-liquid discharging unit 4 that is not easily clogged.

Figure 22:
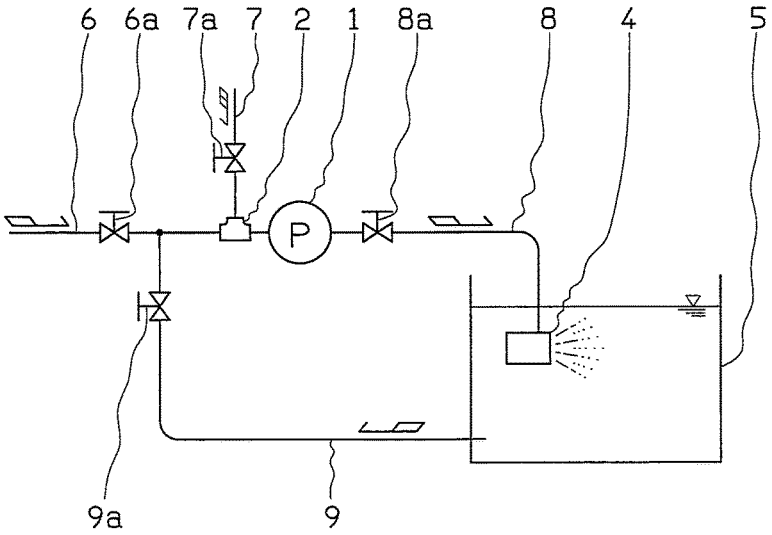
FIG. 22 is an illustrative view showing an example of the configuration of a microscopic bubble generator.
Figure 23:
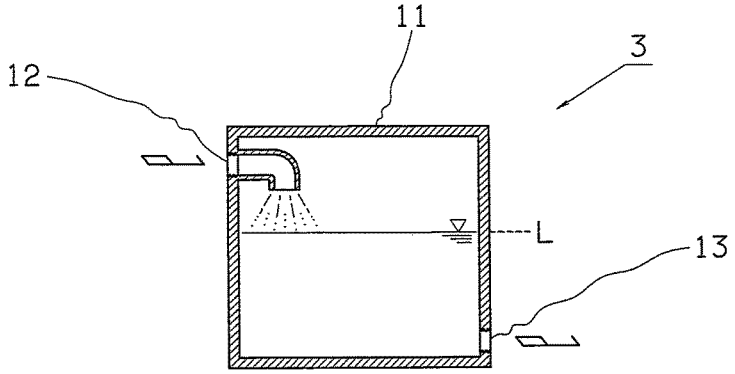
FIG. 23 is a longitudinal cross-sectional view showing an example of a gas-liquid dissolving tank of the prior art.
Figure 24:
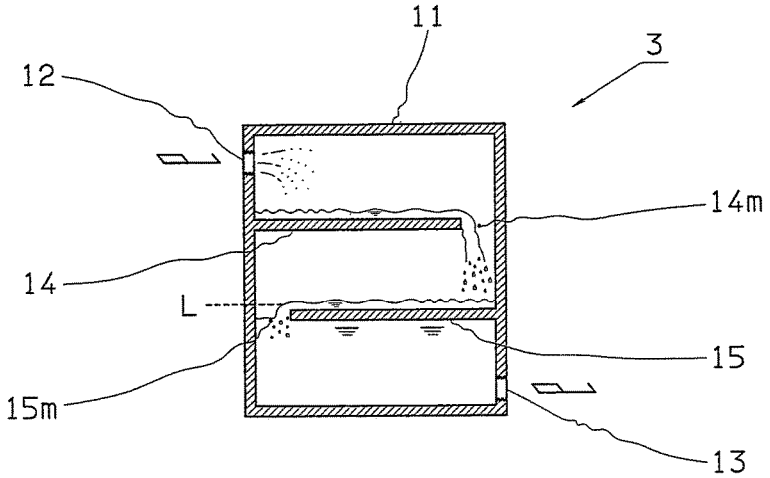
PRIOR ART FIG. 24
FIG. 24 is a longitudinal cross-sectional view showing an example of a gas-liquid dissolving tank of the prior art.
Figure 25:
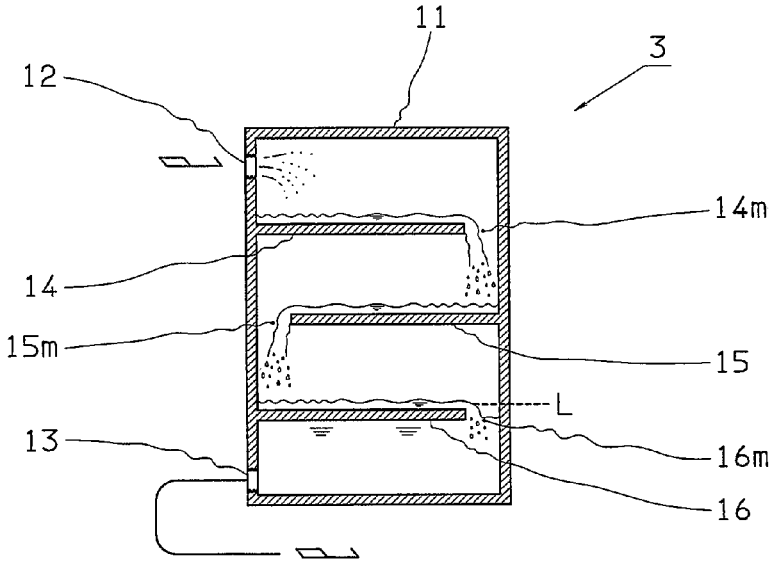
FIG. 25 is a longitudinal cross-sectional view showing an example of a gas-liquid dissolving tank of the prior art.
Figure 26:
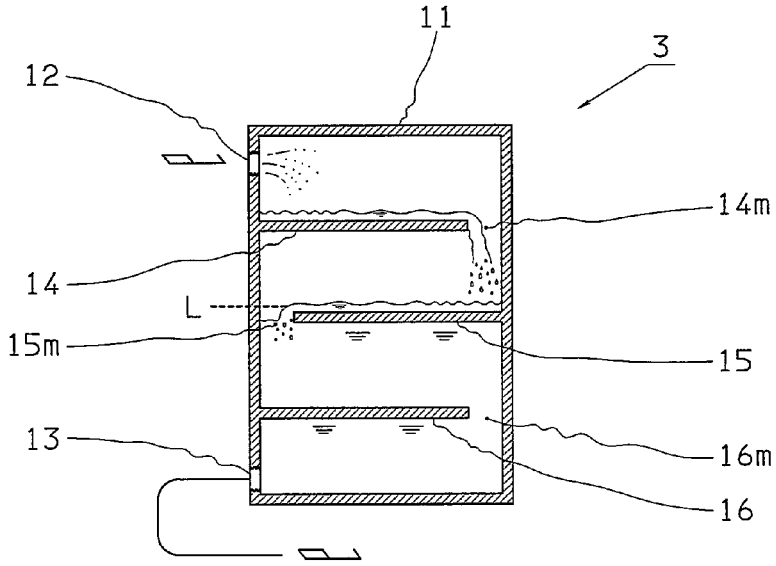
PRIOR ART FIG. 26
FIG. 26 is a longitudinal cross-sectional view showing an example of a gas-liquid dissolving tank of the prior art.

Accordingly, it is possible to achieve performance to a certain degree even with a microscopic bubble generator without the gas-liquid dissolving tank 3, by using the gas-liquid discharging unit 4 of the eleventh embodiment. That is, it is possible to apply the gas-liquid discharging unit 4 of the eleventh embodiment to a microscopic bubble generator including the pumping unit (pump) 1 for pumping liquid, the gas mixing unit 2 for mixing gas with liquid, and the gas-liquid discharging unit 4 for discharging gas-liquid through a channel, similar to the microscopic bubble generator shown in FIG. 22. Obviously, it should be understood that it is more preferable to apply the gas-liquid dissolving tank to the apparatus in order to achieve high performance as a microscopic bubble generator.

Embodiment 12

Figure 20:
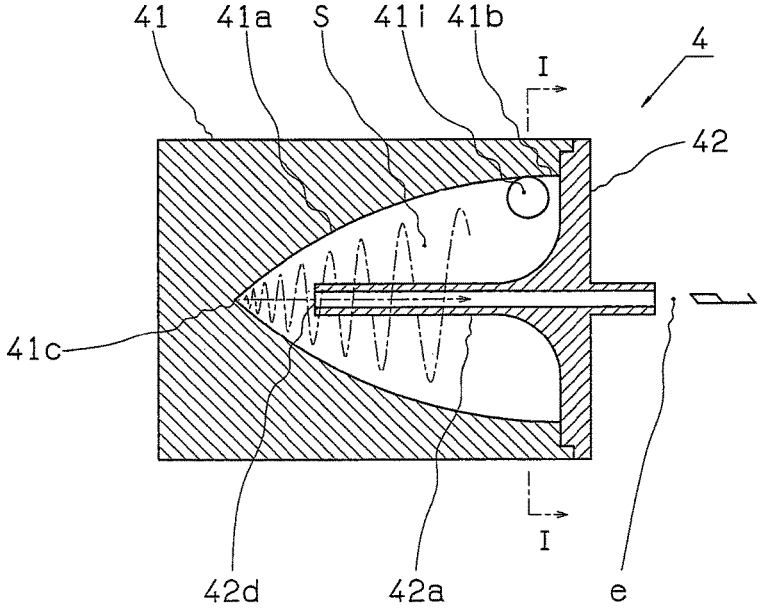
FIG. 20 is a longitudinal cross-sectional view showing a gas-liquid discharging unit of a twelfth embodiment of the present invention.
Figure 21:
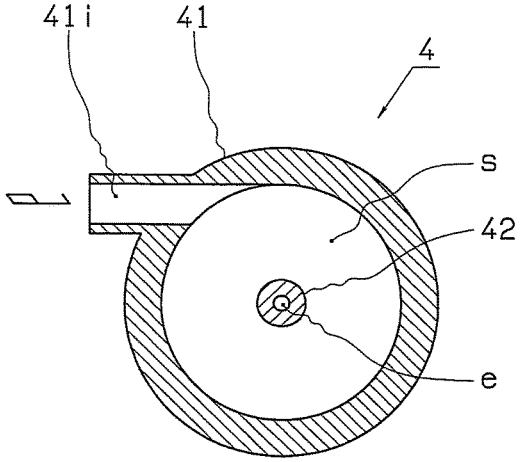
FIG. 21 is a cross-sectional view taken along line I-I in FIG. 20.

FIG. 20 is a longitudinal cross-sectional view showing a gas-liquid discharging unit of a twelfth embodiment of the present invention, and FIG. 21 is a cross-sectional view taken along line I-I in FIG. 20.

This embodiment is another example of the eleventh embodiment, in which the inner wall 41*a* of the empty portion s is formed in the shape of an acorn instead of a simple cone shape, and the portion around the outlet channel 42*d* is made simpler. The shape of the inner wall 41*a* of the empty portion may be appropriately designed in the shape of a trumpet, a wine bottle, and so on.

Other configuration and functions of this embodiment are the same as those of the eleventh embodiment.

Next, common technical matters of the embodiments are described. The pumping unit 1 may be selected from various well-known ones such as a centrifugal pump, a mixed flow pump, an axial-flow pump, a vortex pump, a diaphragm pump, and a gear pump As for the gas-liquid dissolving tank 3, the number of the separation walls may be freely increased, and a plurality of containers 11 may be connected in series or in parallel in order to further improve the performance.

The separation positions and numbers of the members of the gas-liquid dissolving tank 3 or the gas-liquid discharging unit 4 are not limited to those shown in the figures, and appropriate separation positions may be selected in accordance with the design.

Further, various changes in design such as changing the numbers, arrangement, and combination of the basic components or adding technical means of the prior art within the scope of the present invention are possible, the materials may be appropriately selected, and the present invention is not limited to the embodiments described above.

INDUSTRIAL APPLICABILITY OF THE INVENTION

According to the present invention, it is possible to achieve a microscopic bubble generator that can stably and efficiently generate a large amount of microscopic bubbles in liquid in a short time with a simple configuration and that can be easily operated with high performance, and a gas-liquid dissolving tank that can be very suitably used for the apparatus.

The apparatus can be easily cleaned in an assembled state or in a disassembled state even in a process of handling food/beverage or high-purity liquid, satisfying a sanitary condition, can be used without clogging, and can be applied to various usages or various liquids.

The apparatus is used not only for efficiently dissolving gas such as air, oxygen, carbon dioxide, and ozone by making microscopic bubbles in various liquids such as water, food, beverage, oil, and chemical products, but also for using microscopic bubbles of non-dissolved gas in fields such as cosmetic treatment, healthcare, cleaning, and wastewater treatment, or for using various liquids in a foam or a cream state by diffusing microscopic bubbles in the liquids such as foods and cosmetics, making it applicable to various fields.

The apparatus has a simple structure, so it has durability with less breakdown, it can be easily managed because it can be completely automatically operated, and it can be implemented at a low cost even in a small size and a large size. Accordingly, it can be very economically installed and managed, making its implementation extremely effective.

DESCRIPTION OF THE REFERENCE SYMBOLS

1 pumping unit (pump)
2 gas mixing unit
3 gas-liquid dissolution promoting unit (gas-liquid dissolving tank)
4 gas-liquid discharging unit
5 reservoir
6, 7, 8, 9 pipe
6*a*, 7*a*, 8*a*, 8*b*, 9*a* valve
11 container

12 container opening
13 container opening
13*a* container opening upper end
14, 15, 16 separation wall
14*a*, 15*a*, 16*a* separation wall opening upper end
14*b*, 15*b*, 16*b* separation wall opening lower end
14*m*, 15*m*, 16*m* separation wall opening
21 baffle
31 valve port
32 float
33 pipe
34 level gauge
35 sensor
36 driving unit
41 container body
41*a* inner wall of empty portion
41*b* bottom
41*c* point
41*h*, 41*s* channel
41*i* inlet channel
42 container cover
42*a* convex surface
42*d* outlet channel
A, B, C, D predetermined distance
e outlet space
L, L1, L2, L3, L4 liquid level
r1, r2, r3, r4 chamber
s empty portion

The invention claimed is:

1. A gas-liquid dissolving tank that promotes dissolution of gas mixed with liquid in the liquid, wherein openings that pass the flowing gas-liquid are formed at an upper portion and a lower portion of a container of the tank, a plurality of separation walls that vertically divide a plurality of chambers are disposed in the container, openings that connect upper and lower chambers are formed through the separation walls, the upper ends of the openings of the separation walls extend predetermined distances upward from the separation walls, and the lower ends of the openings of the separation walls extend predetermined distances downward from the separation walls, and wherein the shape of the upper end of the opening of the separation wall and/or the separation wall facing the upper end is formed such that ejection flow from the upper end of the opening of the separation wall is substantially horizontally dispersed or diffused, when the flowing gas-liquid flows upward.

2. A microscopic bubble generator, comprising:

a pumping unit that pumps liquid;

a gas mixing unit that mixes gas with the liquid;

a gas-liquid dissolution promoting unit that promotes dissolution of gas-liquid; and a gas-liquid discharging unit that discharges the gas-liquid through a channel, and using the gas-liquid dissolving tank of claim 1 as the gas-liquid dissolution promoting unit.

3. The microscopic bubble generator of claim 2, wherein the gas-liquid discharging unit discharges the gas-liquid through at least one process of passing a throttled channel, passing a narrow gap, rapidly changing direction, and rapidly turning.

4. A gas-liquid dissolving tank that promotes dissolution of gas mixed with liquid in the liquid, wherein openings that pass the flowing gas-liquid are formed at an upper portion and a lower portion of a container of the tank, a plurality of separation walls that vertically divide a plurality of chambers are disposed in the container, openings that connect upper and lower chambers are formed through the separation walls, the upper ends of the openings of the separation walls extend predetermined distances upward from the separation walls, and the lower ends of the openings of the separation walls extend predetermined distances downward from the separation walls, and wherein the upper end of the opening of a separation wall is positioned above the lower end of the opening of another separation wall right above the separation wall.

5. The gas-liquid dissolving tank of claim 4, wherein the shape of the upper end of the opening of the separation wall and/or the separation wall facing the upper end is formed such that ejection flow from the upper end of the opening of the separation wall is substantially horizontally dispersed or diffused, when the flowing gas-liquid flows upward.

6. A microscopic bubble generator, comprising:

a pumping unit that pumps liquid;

a gas mixing unit that mixes gas with the liquid; a gas-liquid dissolution promoting unit that promotes dissolution of gas-liquid; and a gas-liquid discharging unit that discharges the gas-liquid through a channel, and using the gas-liquid dissolving tank of claim 4 as the gas-liquid dissolution promoting unit.

7. A microscopic bubble generator, comprising:

a pumping unit that pumps liquid;

a gas mixing unit that mixes gas with the liquid;

a gas-liquid dissolution promoting unit that promotes dissolution of gas-liquid; and a gas-liquid discharging unit that discharges the gas-liquid through a channel, and using the gas-liquid dissolving tank of claim 5 as the gas-liquid dissolution promoting unit.

8. The microscopic bubble generator of claim 6, wherein an exhaust mechanism for discharging non-dissolved gas accumulated in the gas-liquid dissolving tank is provided in the gas-liquid dissolving tank, and has an exhaust opening that communicates with a gas inlet of the gas mixing unit.

9. The microscopic bubble generator of claim 7, wherein an exhaust mechanism for discharging non-dissolved gas accumulated in the gas-liquid dissolving tank is provided in the gas-liquid dissolving tank, and has an exhaust opening that communicates with a gas inlet of the gas mixing unit.

10. The microscopic bubble generator of claim 6, wherein a sensing unit that senses the degree of accumulation of non-dissolved gas in the gas-liquid dissolving tank is provided in the gas-liquid dissolving tank, and the amount of gas flowing in the gas mixing unit is throttled and adjusted in accordance with the sensed degree of accumulation.

11. The microscopic bubble generator of claim 7, wherein a sensing unit that senses the degree of accumulation of non-dissolved gas in the gas-liquid dissolving tank is provided in the gas-liquid dissolving tank, and the amount of gas flowing in the gas mixing unit is throttled and adjusted in accordance with the sensed degree of accumulation.

12. The microscopic bubble generator of claim 6, wherein the gas-liquid discharging unit discharges the gas-liquid through at least one process of passing a throttled channel, passing a narrow gap, rapidly changing direction, and rapidly turning.

13. The microscopic bubble generator of claim 7, wherein the gas-liquid discharging unit discharges the gas-liquid through at least one process of passing a throttled channel, passing a narrow gap, rapidly changing direction, and rapidly turning.

14. The microscopic bubble generator of claim 6, wherein the gas-liquid discharging unit has a container body having a bottom that is open and tapered, and having a substantially conical empty portion from the point to the opening, and a container cover spaced at a predetermined gap from the inner wall of the empty portion and covering the other portion of the empty portion, an inlet channel for taking gas-liquid inside in a circumferential tangential direction of the inner wall of the empty portion through the container body is formed around a large-diameter portion of the space defined between the container body and the container cover, and an outlet channel for discharging gas-liquid outside through the container cover is formed around the point in the space defined between the container body and the container cover.

15. The microscopic bubble generator of claim 7, wherein the gas-liquid discharging unit has a container body having a bottom that is open and tapered, and having a substantially conical empty portion from the point to the opening, and a container cover spaced at a predetermined gap from the inner wall of the empty portion and covering the other portion of the empty portion, an inlet channel for taking gas-liquid inside in a circumferential tangential direction of the inner wall of the empty portion through the container body is formed around a large-diameter portion of the space defined between the container body and the container cover, and an outlet channel for discharging gas-liquid outside through the container cover is formed around the point in the space defined between the container body and the container cover.

16. A gas-liquid dissolving tank that promotes dissolution of gas mixed with liquid in the liquid, wherein openings that pass the flowing gas-liquid are formed at an upper portion and a lower portion of a container of the tank, a plurality of separation walls that vertically divide a plurality of chambers are disposed in the container, openings that connect upper and lower chambers are formed through the separation walls, the upper ends of the openings of the separation walls extend predetermined distances upward from the separation walls, and the lower ends of the openings of the separation walls extend predetermined distances downward from the separation walls, and wherein an exhaust mechanism for discharging non-dissolved gas accumulated in the container is provided.

17. A microscopic bubble generator, comprising:

a pumping unit that pumps liquid;

a gas mixing unit that mixes gas with the liquid;

a gas-liquid dissolution promoting unit that promotes dissolution of gas-liquid; and a gas-liquid discharging unit that discharges the gas-liquid through a channel;

wherein the gas-liquid dissolution promoting unit uses a gas-liquid dissolving tank that promotes dissolution of gas mixed with liquid in the liquid, wherein:

openings that pass the flowing gas-liquid are formed at an upper portion and a lower portion of a container of the tank, a plurality of separation walls that vertically divide a plurality of chambers are disposed in the container, openings that connect upper and lower chambers are formed through the separation walls, the upper ends of the openings of the separation walls extend predetermined distances upward from the separation walls, and the lower ends of the openings of the separation walls extend predetermined distances downward from the separation walls; and wherein an exhaust mechanism for discharging non-dissolved gas accumulated in the gas-liquid dissolving tank is provided in the gas-liquid dissolving tank, and has an exhaust opening that communicates with a gas inlet of the gas mixing unit.

18. A microscopic bubble generator, comprising:

a pumping unit that pumps liquid;

a gas mixing unit that mixes gas with the liquid;

a gas-liquid dissolution promoting unit that promotes dissolution of gas-liquid; and a gas-liquid discharging unit that discharges the gas-liquid through a channel;

wherein the gas-liquid dissolution promoting unit uses a gas-liquid dissolving tank that promotes dissolution of gas mixed with liquid in the liquid, wherein:

openings that pass the flowing gas-liquid are formed at an upper portion and a lower portion of a container of the tank, a plurality of separation walls that vertically divide a plurality of chambers are disposed in the container, openings that connect upper and lower chambers are formed through the separation walls, the upper ends of the openings of the separation walls extend predetermined distances upward from the separation walls, and the lower ends of the openings of the separation walls extend predetermined distances downward from the separation walls; and wherein a sensing unit that senses the degree of accumulation of non-dissolved gas in the gas-liquid dissolving tank is provided in the gas-liquid dissolving tank, and the amount of gas flowing in the gas mixing unit is throttled and adjusted in accordance with the sensed degree of accumulation.

19. A microscopic bubble generator, comprising:

a pumping unit that pumps liquid;

a gas mixing unit that mixes gas with the liquid;

a gas-liquid dissolution promoting unit that promotes dissolution of gas-liquid; and a gas-liquid discharging unit that discharges the gas-liquid through a channel;

wherein the gas-liquid dissolution promoting unit uses a gas-liquid dissolving tank that promotes dissolution of gas mixed with liquid in the liquid, wherein:

openings that pass the flowing gas-liquid are formed at an upper portion and a lower portion of a container of the tank, a plurality of separation walls that vertically divide a plurality of chambers are disposed in the container, openings that connect upper and lower chambers are formed through the separation walls, the upper ends of the openings of the separation walls extend predetermined distances upward from the separation walls, and the lower ends of the openings of the separation walls extend predetermined distances downward from the separation walls; and wherein the gas-liquid discharging unit has a container body having a bottom that is open and tapered, and having a substantially conical empty portion from the point to the opening, and a container cover spaced at a predetermined gap from the inner wall of the empty portion and covering the other portion of the empty portion, an inlet channel for taking gas-liquid inside in a circumferential tangential direction of the inner wall of the empty portion through the container body is formed around a large-diameter portion of the space defined between the container body and the container cover, and an outlet channel for discharging gas-liquid outside through the container cover is formed around the point in the space defined between the container body and the container cover.

20. A microscopic bubble generator, comprising:

a pumping unit that pumps liquid;

a gas mixing unit that mixes gas with the liquid; and a gas-liquid discharging unit that discharges the gas-liquid through a channel, wherein the gas-liquid discharging unit has a container body having a bottom that is open and tapered, and having a substantially conical empty portion from the point to the opening, and a container cover spaced at a predetermined gap from the inner wall of the empty portion and covering the other portion of the empty portion, an inlet channel for taking gas-liquid inside in a circumferential tangential direction of the inner wall of the empty portion through the container body is formed around a large-diameter portion of the space defined between the container body and the container cover, and an outlet channel for discharging gas-liquid outside through the container cover is formed around the point in the space defined between the container body and the container cover.

* * * * *